US011519162B1

(12) United States Patent
Amendariz

(10) Patent No.: US 11,519,162 B1
(45) Date of Patent: Dec. 6, 2022

(54) CLOG SAVER DEVICE FOR A TOILET SYSTEM

(71) Applicant: Justin L. Amendariz, Las Cruces, NM (US)

(72) Inventor: Justin L. Amendariz, Las Cruces, NM (US)

( * ) Notice: Subject to any disclaimer, the term of this patent is extended or adjusted under 35 U.S.C. 154(b) by 0 days.

(21) Appl. No.: 17/457,662

(22) Filed: Dec. 5, 2021

(51) Int. Cl.
*E03C 1/264* (2006.01)
*E03D 11/13* (2006.01)

(52) U.S. Cl.
CPC ..... *E03C 1/264* (2013.01); *E03D 11/13* (2013.01)

(58) Field of Classification Search
CPC ..... E03C 1/264; E03C 1/26; E03D 11/13
USPC ..... 4/256.1, 286, 288, 292
See application file for complete search history.

(56) References Cited

U.S. PATENT DOCUMENTS 557,762 A * 4/1896 Brockman ..... E03C 1/264 4/292
782,860 A * 2/1905 Lever ..... E03C 1/264 285/192
1,886,676 A 11/1932 Heuacker
2,281,448 A * 4/1942 Mathey ..... B60K 15/0403 220/86.3
2,433,423 A * 12/1947 Broadman ..... E03F 5/0404 210/451
2,506,669 A * 5/1950 Heuacker ..... E03C 1/264 220/86.3
2,598,543 A 5/1952 Hoffman et al.
2,617,996 A 11/1952 Hoffman et al.
2,693,603 A 11/1954 Lehmann
2,733,816 A 2/1956 Griffith
2,785,561 A 3/1957 Hoffman et al.
2,811,724 A 11/1957 Click
2,908,513 A * 10/1959 Karlinski ..... E03D 11/16 285/58
2,974,324 A 3/1961 Lundelius
3,268,920 A 8/1966 Beer
3,393,408 A * 7/1968 Martin ..... E03D 11/00 43/61
4,307,476 A 12/1981 Halstad
4,384,910 A * 5/1983 Prodyma ..... E03D 11/14 4/DIG. 9

(Continued)

*Primary Examiner* — David P Angwin
*Assistant Examiner* — William R Klotz
(74) *Attorney, Agent, or Firm* — George L. Walton; Parts LLC

(57) ABSTRACT

A toilet apparatus comprising a toilet bowl with a drain passageway, and a mounting support base, a wax ring having a central opening disposed below the mounting support base, the wax ring is supported on an annular clog saver plate member having a central opening with an annular wall portion, a mounting flange plate supporting the annular clog saver plate member with an extending portion for sealing a sewer passageway. The annular wall portion includes a plurality of clog saver fins attached thereto. These clog saver fins are used to catch non-passable feminine hygiene items, disposable pampers, packaging, and clothing to prevent a sewer blockage, and removal therefrom without removing the toilet bowl, while allowing passable feminine hygiene items, fluid, tissue, toilet liners, and waste material to pass through the central openings in the wax ring, clog saver plate member and mounting flange plate, and into the sewer passageway.

20 Claims, 5 Drawing Sheets

(56) References Cited

U.S. PATENT DOCUMENTS

| | | | | | |
|---|---|---|---|---|---|
| 5,117,862 | A * | 6/1992 | Molligan | E03C 1/26 | 4/256.1 |
| 5,185,890 | A * | 2/1993 | Dismore | E03D 11/16 | 4/252.5 |
| 5,481,766 | A * | 1/1996 | Steadman | A01M 29/30 | 4/286 |
| D421,295 | S * | 2/2000 | Barnett | D23/261 | |
| 6,026,521 | A * | 2/2000 | Atkins | E03D 11/16 | 285/15 |
| 7,069,603 | B2 * | 7/2006 | Flushing | E03D 11/16 | 4/251.1 |
| 7,967,225 | B1 * | 6/2011 | Schulz | E03C 1/266 | 241/46.016 |
| 8,099,801 | B2 * | 1/2012 | Hughes | E03D 11/16 | 4/252.5 |
| 8,141,177 | B1 * | 3/2012 | Majocka | E03D 11/14 | 4/252.2 |
| 8,201,280 | B1 * | 6/2012 | Nally, Jr. | E03D 11/13 | 4/256.1 |
| 8,201,281 | B2 | 6/2012 | Hanifl et al. | | |
| 9,068,678 | B2 * | 6/2015 | Whitehead | F16L 23/024 | |
| 9,157,224 | B2 | 10/2015 | Hanifl et al. | | |
| 9,228,368 | B2 * | 1/2016 | Barnett | E04H 4/14 | |
| 10,669,707 | B2 * | 6/2020 | Schuster | F16L 5/10 | |
| 2011/0023219 | A1 | 2/2011 | Hanifl et al. | | |
| 2018/0171611 | A1 * | 6/2018 | Ratledge | E03C 1/22 | |

* cited by examiner

CLOG SAVER DEVICE FOR A TOILET SYSTEM

BACKGROUND OF THE INVENTION

1. Field of the Invention

The present invention relates generally to a new and useful improvement clog saving device for preventing the clogging of main sewer or plumbing lines to obviate a potential backup, preferably in a toilet system.

It is well known that one of the major plumbing problem is main sewer line clogging and back-ups in toilet systems in residential and commercial environments. This major plumbing problem occurs more often in multiple dwelling units, such as apartments, townhouses, condominiums, and commercial buildings where toilet systems are generally mounted back-to-back and connected to the same main sewer line. In these types of units occupants will throw and flush down items, such as disposable pampers or cloth diapers, packaging, clothing type articles, small bottles and containers, and other types of items in toilet systems. Note that such items can cause a major sewer line blockage that can impact and shutdown multiple toilet systems in the multiple dwelling units described above causing an inconvenience to many occupants. This type of sewer line blockage will require labor intensive and costly repairs.

2. Description of the Related Art

It is well known in the art to utilize clog saving type devices to prevent clogs in main sewer lines or waste fluid outlets that causes toilet system back-ups. Many of these clog saving type devices are referenced in the following prior art.

In U.S. Pat. No. 2,693,603 A to Herman M. Lehman teaches a catch ring or a spring wire type device (20, 24, 31) with hook catching members (21, 21x, 28, 30, 30') for catching articles in a toilet bowl (10, 11). The catch ring or the spring wire type device (20, 24, 31) is positioned within the outlet passage (12) of the toilet bowl (10, 11) for retaining articles therein for easy removal of any trapped articles.

In U.S. Pat. No. 2,811,724 A to Billy J. Click et al teaches a bowl guard in the form of a clip member (24, 24a, 26, 26a, 28, 28a-31a) for arresting cloth articles in a toilet bowl (10). The clip member (24, 24a, 26, 26a, 28, 28a-31a) is positioned at a bottom end of front wall (20) located at the inlet of the outlet tortuous passage (22) formed between the front wall (20) and the back wall (16, 18).

In U.S. Pat. No. 3,268,920 A to Donald C. Beer teaches a debris collector (10-17) positioned within waste trap fluid outlets of receptacles of varied sizes, and of varied materials including radially extending fingerlike members (10-12) with upstanding and angled barb members (13-15) or spike members (16-17) that are effective for trapping hairs or other strand-like waste material that can cause a blockage within the waste trap fluid outlets. When the radially extending fingerlike members (10-12) with the upstanding and angled barb members (13-15) or spike members (16-17) are positioned with the waste trap fluid outlets very little of the waste fluid outlet are blocked, which allows the upstanding and angled barb members (13-15) or spike members (16-17) to effectively trap hairs or other strand-like waste material that become entangled thereon.

In U.S. Pat. No. 4,307,476 A teaches a clog prevention device comprising an annular split ring (17, 18) with a plurality of spaced apart hooklike members (20-26) secured to the annular split ring (20-27) by a weld 22. The annular split ring (17, 18) is embedded in a wax ring (27) that is disposed in a space (15) at the bottom outlet flange (14) of the outlet passage (13) of the toilet bowl unit (10-16). The design of the hooklike members (20-26) defining sharp points (26) to shred toilet tissue, but also act as hooks (25-26) to catch any undesirable material and preventing such from entering sewer lines to obviate any blockage therein.

Further, the following U.S. Pat. Nos. 1,886,676 A, 2,598,543 A, 2,617,976 A, 2,733,816 A, 2,785,561 A, 2,974,324 A, 8,201,281 B2, 9,157,224 B2, 2011/0023219 A1, 2012/0278983 A1, and 2015/0376886 A1 are hereby cited to show other types of prior art sewer or drain line clog saving devices of interest.

Note that none of the above mentioned patent clog saving type devices, taken either singly or in combination thereof, is seen to describe a separate annular and universal clog saver plate member that is adaptable to be disposed or sandwiched between a floor or wall flange and a wax ring that teaches the new and useful improvement of the present invention as claimed, which will be discussed in greater detail in the "Summary of the Invention", recited below.

SUMMARY OF THE INVENTION

It is an object of the present invention to provide an annular and universal clog saving plate assembly for a toilet system comprising a toilet bowl with a drain or outlet passageway, a floor mounting flange or a wall mounting flange having a top surface and a lower extending portion with sealing rings or members disposed thereon, an annular and universal clog saver plate member and an annular wax ring, each having a top surface, a bottom surface, and a central opening defining an annular inner wall surface face. The annular inner wall surface face of the clog saver plate member includes a plurality of spaced apart clog saver fins attached thereto. These spaced apart clog saver fins are used to catch non-passable items, such as, feminine hygiene items, disposable pampers, cloth diapers, packaging items, clothing items, and other non-passable items to prevent a sewer line or passageway blockage, while only allowing passable items, such as, feminine hygiene items, fluid, tissue, toilet liners, dissolvable items, waste material, and other passable items to flow through the central opening in the annular and universal clog saver plate member and into the sewer line or passageway via the central openings in the wax ring and the floor or wall mounting flange plate. Also, the bottom surface of the annular and universal clog saver plate member is disposed or rests on top of the floor mounting flange plate or the wall mounting flange plate and the bottom surface of the wax ring is disposed or rests on the top surface of the annular and universal clog saver plate member. Also, the top surface of the wax ring is disposed below and against a bottom base portion of the toilet bowl upon attachment of the toilet bowl to the floor mounting flange or the wall mounting flange plate. Further, the lower extending portion with the sealing rings or members are disposed within a floor or wall drain opening or sewer line or passageway thereby preventing fluid leakage.

Another object of the present invention provides a plurality of securing openings or holes extending through the floor or wall mounting flange plate. A plurality of anchor bolts or studs are secured into a building infrastructure defining a floor structure or surface, such as concrete for receiving a plurality of screw members therein via the plurality of securing openings in the floor mounting flange plate for securing the floor mounting flange plate to the concrete floor surface.

For the wall mounting flange plate, a plurality of securing openings or holes are disposed in the wall mounting flange plate for securing the wall mounting flange plate to the wall structure by a plurality of screw members through the plurality of securing openings within the wall mounting flange plate.

It is another object of the present invention to provide the annular and universal clog saver plate member with at least a pair of separate mounting securing holes or openings, one pair of the separate mounting securing holes or openings include elongated adjustable slots having a first diameter portion that decreases to a second diameter portion that are disposed in the annular and universal clog saver plate member that aligns and mates with elongated adjustable slots in the floor mounting flange having a first diameter portion that decreases to a second diameter portion. The other at least a pair of separate mounting securing holes or openings includes a U-shaped slot that opens outwardly at the peripheral edge of the universal clog saver plate member that aligns and mate with at least a pair of securing holes or openings in the wall mounting flange plate.

A further object of the present invention provides at least a pair of the plurality of screw members for securing the wall mounting flange plate to the building infrastructure, such as a wall structure by extending the plurality of screw members through the pair of U-shaped slots of the annular and universal clog saver plate member to secure the annular and universal clog saver plate member to the top surface of the wall mounting flange plate and through the plurality of securing holes or openings within the wall mounting flange plate.

It is another object of the present invention to provide a pair of locking threaded bolt members including a head portion disposed thereon defining a locking flange member. The pair of locking threaded bolt members passes easily up through the first diameter portion of the elongated adjustable slots in the floor mounting flange plate, and upward through the first diameter portion of the elongated adjustable slots in the annular and universal clog saver plate member and through an optional lock washer. Once the pair of locking threaded bolt members extend through the annular and universal clog saver plate member, the pair of locking threaded bolt members are able to slide easily into and along the elongated adjustable slots of the second diameter portions of the floor mounting flange and the annular and universal clog saver plate member as the pair of locking flange members move along and underneath the second diameter portions of the elongated adjustable slots of the floor mounting flange. The optional lock washer locks each one of the locking threaded bolt members in place after the locking flange members are positioned underneath each one of the elongated adjustable slots of the second diameter portions of the floor mounting flange plate and the lock washer is positioned above and in engagement with the floor mounting flange plate. Note that the lock washer can be omitted, if desired.

Another object of the present invention provides a pair of securing holes in the bottom base portion of the toilet bowl that receives and aligns the pair of locking threaded bolt members there through and having a portion thereof that extend to a selected distance there above. Note that the pair of locking threaded bolt members are easily received and aligned with the pair of securing holes in the bottom base portion of the toilet bowl as they are slidably moved from the first diameter portions to the second diameter portions of the pair of the elongated adjustable slots of the universal clog saver flange member and the pair of the elongated adjustable slots in the floor mounting flange plate as the locking flange members move along and underneath the second diameter portions of the pair of the elongated slots of the floor mounting flange plate.

Furthermore, once the pair of locking threaded bolt members extended portion that is positioned above the securing holes or openings of the bottom base portion of the toilet bowl receives a retaining washer and a threaded nut for threading the threaded nut along each one of the pair of locking threaded bolt members extended portion until they firmly seat against each one of the retaining washers for tightly securing the toilet bowl to the floor mounting flange. Once the threaded nut has been fully tightened the wax ring is sealingly compressed between the bottom base portion of the toilet bowl and the annular and universal clog saver plate member to fully seal the drain outlet passageway of the toilet bowl that is fluidly connected to the floor drain opening or sewer line or passageway via the central openings in the wax ring, the clog saver plate member, and the floor mounting flange. After the threaded nut has been fully tightened, a decorative cap member is placed over the threaded nut for esthetic purposes.

Moreover, a plurality of anchor bolts or studs are disposed within or behind a wall structure for receiving a fastening nut member for firmly securing the anchor bolts or studs within the wall structure. The plurality of anchor bolts or studs extends through a plurality of anchor bolt or studs securing holes or openings disposed within the wall structure with a portion thereof that extend a selected distance there through. This extended portion is received through a plurality securing openings or holes within a rear or back side of a wall mounted toilet bowl for receiving a retaining washer and a threaded nut. After the threaded nut is threaded along each one of the plurality of anchor bolts or studs extended portion until they firmly seat against each one of the retaining washers for tightly securing the toilet bowl to the wall mounting flange plate. Once the threaded nut has been fully tightened the wax ring is sealingly compressed between the rear or back side of the toilet bowl and the annular universal clog saver plate member to fully seal the drain outlet passageway of the toilet bowl that is fluidly connected to the wall drain opening or sewer line or passage via the central openings in the wax ring, the clog saver plate member, and the wall mounting flange plate. After the nut has been fully tightened, a decorative cap member is placed over the threaded nut for esthetic purposes.

Note that when the annular and universal clog saver plate member is used with a wall-mounted toilet bowl, it is imperative that the pair of U-shaped slots of the annular and universal clog saver plate member mounting points must be installed on a level plane, and oriented so that they are located at 3 o'clock and 9 'clock positions relative to and aligned with a pair of the plurality of securing holes in the wall mounting flange plate. This orientation places the highest most clog saver fin at the 12 o'clock position and the two remaining clog saver fins are located at 8 o'clock and 4 o'clock positions defining the correct and non-clogging installation. However, if the annular and universal clog saver plate member is oriented 180 degrees and the lowest clog saver fin is positioned at the 6 o'clock position there will be recurring clogging due to all solids passing over the lowest positioned clog saver fin, which would be considered the incorrect installation position.

An additional object of the present invention teaches that the annular and universal clog saver plate member and the plurality of clog saver fins can be made of varied materials selected from the group consisting of plastics and metals. Also, the clog saver fins can be of varied sizes and shapes, if desired. Further, the plurality of clog saver fins can be positioned at varied angles within the central opening thereof, if desired. Moreover, the central opening of the annular and universal clog saver plate member can be of varied sizes. Note that packaging items, large feminine hygiene items, clothing items, disposable pampers, cloth diapers, and other sizable items would be caught and collected by the plurality of clog saver fins of the annular and universal clog saver plate member. These items are able to be removed easily without having to remove the toilet bowl by isolating the clogged items between the plurality of clog saver fins and the toilet bowl. Optionally, the central opening of the annular and universal clog saver plate member can be of selected varied sizes without including clog saver fins that would allow fluid, tissue, toilet liners, waste material, small feminine hygiene items, dissolvable items, and other small items to pass there through, while preventing any sewer line or passageway blockage, if desired.

Yet another object of the present invention is to provide a simple closet auger (not shown) for removing the above large feminine hygiene items, disposable pampers, cloth diapers, clothing items, packaging items, and other sizable items that have been caught by the clog saver fins and the top of the annular and universal clog saver plate member, which isolates the clog adjacent to or at the toilet bowl without ever reaching the sewer line or passageway. Therefore, a toilet technician can easily remove the above collected items by using the simple closet auger (not shown).

An additional object of the present invention provides the clog saver fins to be secured to the annular inner wall surface of the central opening of the clog saver plate member by a bonding process selected at least from the group consisting of chemical bonding, welding, soldering, cementing, and gluing.

Additional aspects, objectives, features and advantages of the present invention will become better understood with regard to the following description and the appended claims of the preferred embodiments with reference to the accompanying drawings.

BRIEF DESCRIPTION OF THE DRAWINGS

The present invention may be better understood, along with its numerous objects, features, and advantages made apparent to those skilled in the art by referencing the accompanying drawings.

DETAILED DESCRIPTION

The present invention defines a toilet assembly having an annular and universal clog saver plate member including a central opening disposed therein with a plurality of spaced apart clog saver fins directly and integrally attached at a selected angle that extends radially inward along an annular inner wall surface face the central opening. These radially inward extending plurality of spaced apart clog saver fins are used to catch non-passable items, such as, feminine hygiene items, disposable pampers, cloth diapers, packaging items, clothing items, and other large items to prevent a sewer line or passageway blockage, while only allowing passable items, such as, feminine hygiene items, fluid, tissue, toilet liners, dissolvable items, waste material, and other passable items to flow through the central opening in the annular and universal clog saver plate member and into the sewer line or passageway via a drain outlet or passageway of a toilet bowl, a central opening in a wax ring and a central opening in a floor or wall mounting flange.

Figure 1:
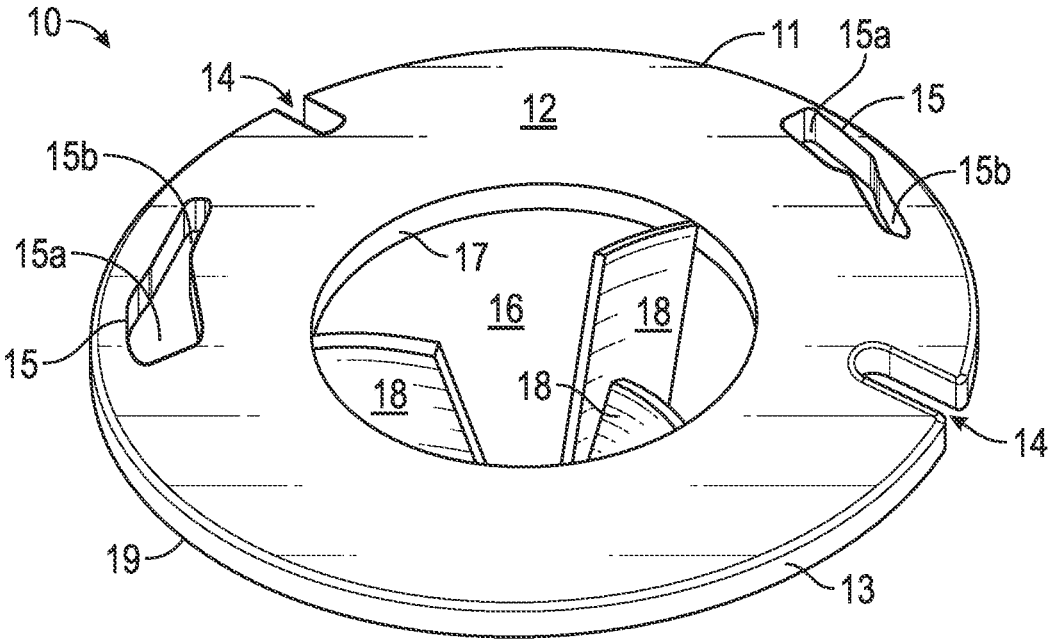
FIG. 1 illustrates a top perspective view of a clog saver plate member with a central opening having an annular inner wall surface face for securing a plurality of angled and radially inward extending spaced apart clog saver fins of a selective larger size thereto and a plurality of securing slots disposed through a surface thereon according to the present invention.

FIG. 1 illustrates the main inventive element of the instant application. This inventive element is defined as a new and useful improved clog saver device for preventing the clogging of main sewer or plumbing lines to obviate a potential and costly backup, preferably in a toilet system.

This new and useful improved clog saver device 10 includes an annular and universal clog saver plate member 11 having a top surface 12, a bottom surface 19, and a central opening 16 defining an annular inner wall surface face 17. The annular inner wall surface face 17 of the annular and universal clog saver plate member 11 includes a plurality of spaced apart clog saver fins 18 that are directly and integrally attached to the annular inner wall surface face 17, and extending radially inward within the central opening 16. These plurality of radially inward extending spaced apart clog saver fins 18 are designed to catch non-passable items such as, feminine hygiene items, disposable pampers, cloth diapers, packaging, clothing, and other large items to prevent a sewer line or passageway blockage, while only allowing passable items, such as, feminine hygiene items, fluid, tissue, toilet liners, dissolvable items, waste material, and small items to flow through the central opening 16 in the annular and universal clog saver plate member 11 and into a sewer line or passageway 68 (See FIG. 6) or 89*c* (See FIG. 7).

Further, the annular and universal clog saver plate member 11 having a first pair of separate and oppositely located securing holes or openings defined as elongated adjustable slots 15 having a first diameter portion 15*a* that decreases to a second diameter portion 15*b* extending through the annular and universal clog saver plate member 11. A second pair of separate and oppositely located securing holes or openings defined as U-shaped slots 14 that opens outwardly at the peripheral edge of the annular and universal clog saver plate member 11.

Figure 2:
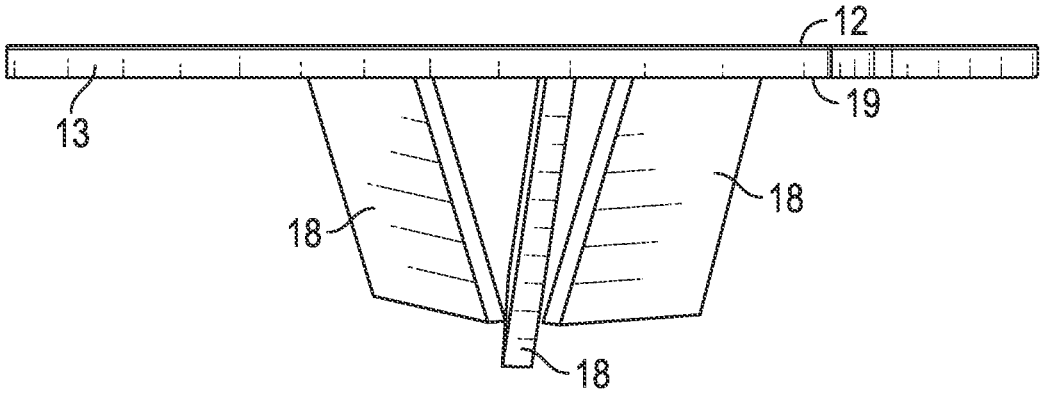
FIG. 2 illustrates a perspective side view of a clog saver plate member with a plurality of angled clog saver fins extending from the central opening thereof to a selected distance below the bottom surface thereof according to the present invention.

FIG. 2 shows a side view of the annular and universal clog saver plate member 11 having the plurality of spaced apart and radially inward extending clog saver fins 18 extending a selected distance below the bottom surface 19 of the annular and universal clog saver plate member 11 at a selected angle relative to the central opening 16.

Figure 3:
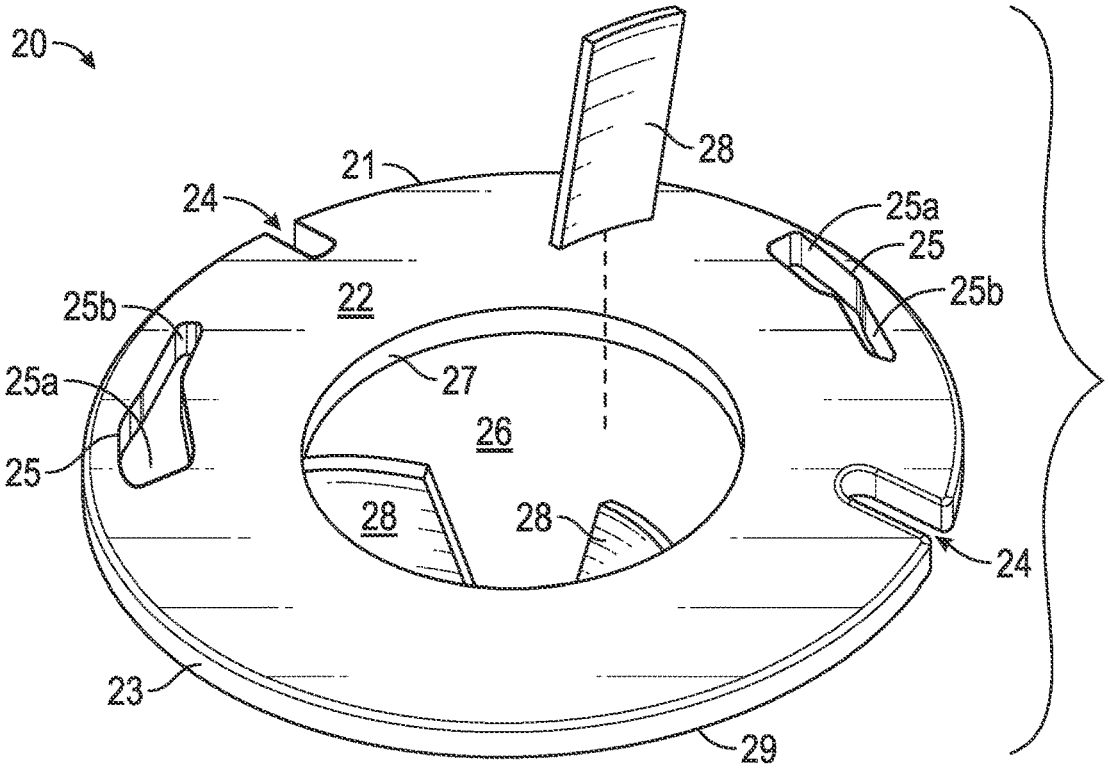
FIG. 3 illustrates a top perspective view of a clog saver plate member with a central opening having an annular inner wall surface face for securing a plurality of angled and radially inward extending spaced apart clog saver fins of a selective smaller size directly and integrally thereto and a plurality of securing slots disposed through a surface thereon according to the present invention.

FIG. 3 shows a new and useful improved clog saver device 20 that is similar to the clog saver device 10 except for the size of a plurality of spaced apart and radially inward extending clog saver fins 28. The clog saver device 20 includes an annular and universal clog saver plate member 21 having a top surface 22, a bottom surface 29, and a central opening 26 defining an annular inner wall surface face 27. The annular inner wall surface face 27 of the annular and universal clog saver plate member 21 includes a plurality of spaced apart and radially inward extending clog saver fins 28 that are directly and integrally attached thereto. These plurality of spaced apart and radially inward extending clog saver fins 28 are designed to catch non-passable items such as, feminine hygiene items, disposable pampers, cloth diapers, packaging, clothing, and other non-passable items to prevent a sewer line or passageway blockage, while only allowing passable items, such as, feminine hygiene items, fluid, tissue, toilet liners, dissolvable items, waste material, and small items to flow through the central opening 26 in the annular and universal clog saver plate member 21 and into a sewer line or passageway 68 (See FIG. 6) or 89*c* (See FIG. 7). Note that the plurality of spaced apart and radially inward extending clog saver fins 28 are smaller in size than the plurality of spaced apart and radially inward extending clog saver fins 18 of FIG. 1.

Moreover, in FIG. 3 the annular and universal clog saver plate member 21 includes a first pair of separate and oppositely located securing holes or openings defined as elongated adjustable slots 25 having a first diameter portion 25*a* that decreases to a second diameter portion 25*b* extending through the annular and universal clog saver plate member 21. A second pair of separate and oppositely located securing holes or openings defined as U-shaped slots 24 that opens outwardly at the peripheral edge of the annular and universal clog saver plate member 21.

Figure 4:
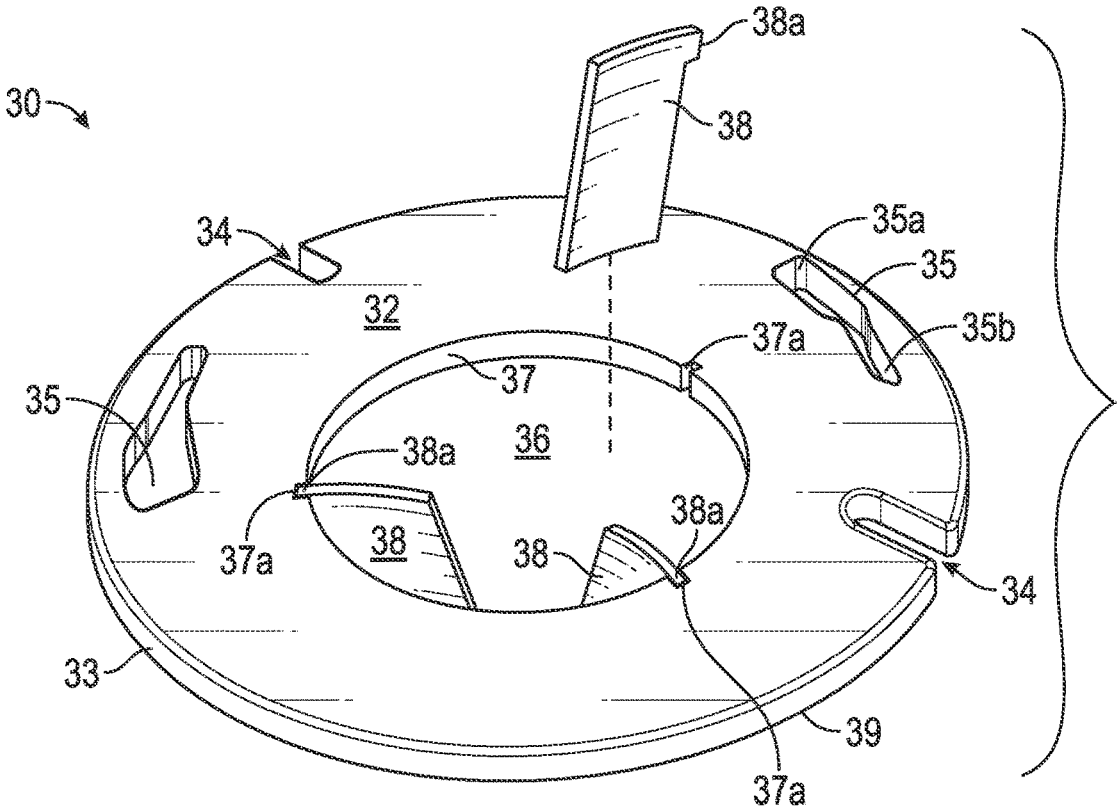
FIG. 4 illustrates a top perspective view of a clog saver plate member with a central opening having an annular inner wall surface face with a plurality of notches therein for receiving and directly and integrally attaching a tab member within then plurality of notches that is integrally extending from a plurality of angled and radially inward extending spaced apart clog saver fins of a selective smaller size and a plurality of securing slots disposed through a surface thereon according to the present invention.

FIG. 4 shows a new and useful improved clog saver device 30 that is similar to the clog saver device 20 except for how the plurality of spaced apart and radially inward extending clog saver fins 38 are attached. The clog saver device 30 includes an annular and universal clog saver plate member 31 having a top surface 32, a bottom surface 39, and a central opening 36 defining an annular inner wall surface face 37 with a plurality of securing slots 37*a* thereon. The annular inner wall surface face 37 of the annular and universal clog saver plate member 31 includes a plurality of spaced apart and radially inward extending clog saver fins 38 with a securing tab 38*a* disposed at a top edge thereof. Further, the securing tabs 38*a* are securely attached directly and integrally within the securing slots 37*a*. Note that these plurality of spaced apart and radially inward extending clog saver fins 38 of the annular and universal clog saver plate member 31 are designed to catch non-passable items such as, feminine hygiene items, disposable pampers, cloth diapers, packaging, clothing, and other non-passable items to prevent a sewer line or passageway blockage, while only allowing passable items, such as, feminine hygiene items, fluid, tissue, toilet liners, dissolvable items, waste material, and other passable items to flow through the central opening 36 in the annular and universal clog saver plate member 31 and into a sewer line or passageway 68 (See FIG. 6) or 89*c* (See FIG. 7). Note that the plurality of spaced apart and radially inward extending clog saver fins 38 as shown are basically the same size as the plurality of spaced apart and radially inward extending clog saver fins 28 of FIG. 3.

Also, in FIG. 4 the annular and universal clog saver plate member 31 includes a first pair of separate and oppositely located securing holes or openings defined as elongated adjustable slots 35 having a first diameter portion 35*a* that decreases to a second diameter portion 35*b* extending through the annular and universal clog saver plate member 31. A second pair of separate and oppositely located securing holes or openings defined as U-shaped slots 34 that opens outwardly at the peripheral edge of the annular and universal clog saver plate member 31.

Note that the plurality of spaced apart and radially inward extending clog saver fins 18, 28 and 38 are preferably secured directly and integrally to the annular inner wall surface faces 17, 27 and 37 by a bonding process selected at least from the group consisting of chemical bonding, welding, soldering, cementing, and gluing. Further, the selected bonding process will secure the plurality of tabs 38*a* of the plurality of spaced apart and radially inward extending clog saver fins 38 within the plurality of securing slots 37*a* of the annular inner wall surface face 37. Also, other types of mechanical fastening means for attaching the plurality of spaced apart and radially inward extending clog saver fins 18, 28 and 38 to the annular inner wall surface faces 17, 27 and 37 could be selected from the group consisting of screws, rivets, pins, and nuts and bolts, if desired.

In addition, the annular and universal clog saver plate members 11, 21, 31 and the plurality of spaced apart and radially inward extending clog saver fins 18, 28, and 38 can be made of varied materials selected from the group consisting of plastics and metals. Also, the plurality of spaced apart and radially inward extending clog saver fins 18, 28, and 38 can be of varied sizes and shapes, if desired. Further, the plurality of spaced apart and radially inward extending clog saver fins 18, 28, and 38 can be positioned at varied angles within the central openings 16, 26, and 36 thereof, and may extend at varied lengths below the central openings 16, 26, and 36 of the annular and universal clog saver plate members 11, 21, 31, if desired. Such varied sizes and shapes are adapted to accommodate varied toilet systems in residential and commercial environments for preventing the clogging of sewer line or passageway 68 (See FIG. 6) or 89*c* (See FIG. 7) to obviate potential and costly backups.

Optionally, the central openings 16, 26, and 36 of the annular and universal clog saver plate members 11, 21, and 31 can be of selected varied sizes without including a plurality of spaced apart and radially inward extending clog saver fins 18, 28, and 38 that would allow fluid, tissue, toilet liners, waste material, passable items, such as, feminine hygiene items, dissolvable items, and other small items to pass there through, while preventing any sewer line or passageway blockage, if desired. Note that non-passable items, such as, packaging items, feminine hygiene items, clothing items, disposable pampers, cloth diapers, and other non-passable items would be caught and collected by the plurality of spaced apart clog saver fins 18, 28, and 38 of the annular and universal clog saver plate members 11, 21, and 31. Therefore, the removal of these collected non-passable items stated above can be removed by a simple closet auger (not shown), which isolates a clog of such non-passable items directly between the plurality of spaced apart and radially inward extending clog saver fins 18, 28, and 38 and the toilet bowl assemblies 30', 60, 80, and 90 (See FIGS. 5-8) without ever reaching the sewer line or passageway 68 (See FIG. 6) or 89*c* (See FIG. 7) and thus eliminating the need for removal of the toilet bowl assemblies 30', 60, 80, and 90 as shown in FIGS. 5-8.

Figure 5:
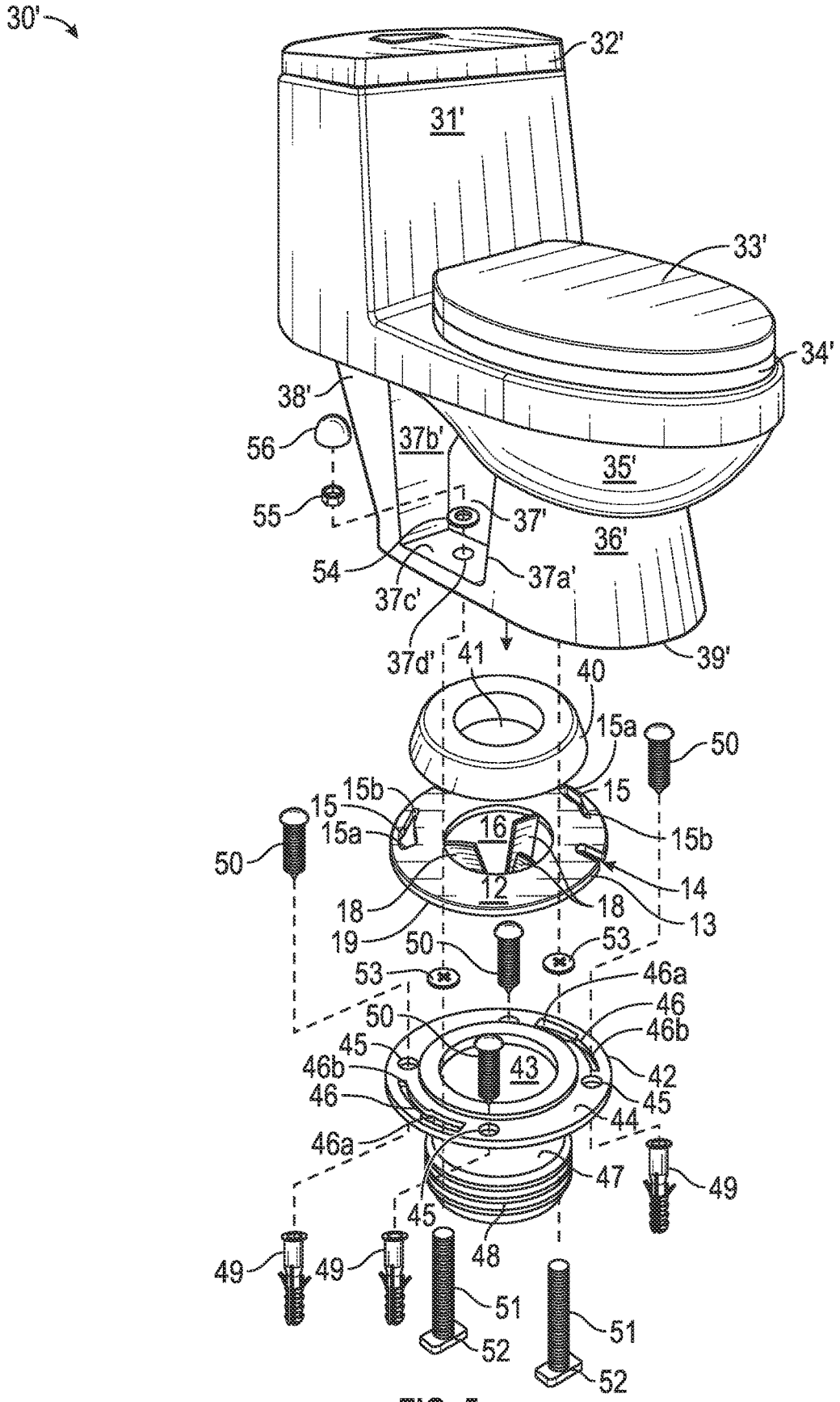
FIG. 5 illustrates an exploded view of a toilet assembly including a toilet bowl with a wax ring, an annular and universal clog saver plate member with a plurality of angled and radially inward extending spaced apart clog saver fins secured within a central opening thereof disposed between a floor mounting flange plate secured to a floor infrastructure by a plurality of anchor bolts or studs and a plurality of securing screw members, and a plurality of flange bolts extending from the floor mounting flange to the toilet bowl for securing the wax ring, and the annular and universal clog saver plate member therebetween by a lock washer, retaining washer, threaded nut and cap member.

Now referring to FIG. 5, which shows an exploded view of a floor mount toilet bowl assembly 30' utilizing a new and improved clog saver plate member 11. The new and improved clog saver plate member 11 is positioned between a wax ring 40, and a floor mounting flange 42 with a toilet bowl assembly 31'-39' disposed above the wax ring 40.

The toilet bowl assembly 30' as shown in FIG. 5 includes a water tank 31', a water tank cover 32', a toilet seat cover 33', a toilet seat 34', a toilet bowl 35' with an internal bowl water chamber (not shown), a front toilet bowl support base 36', a rear toilet tank support base 38' and a recess 37' defined between the front toilet bowl support base 36', and the rear toilet tank support base 38' as an integral support base. Further, the recess 37' has a front wall 37*a*' defined by the front toilet bowl support base 36', a rear wall 37*b*' that is defined by the rear toilet tank support base 38', and a bottom support base integrally connected between the front wall 37*a*' and the rear wall 37*b*'. The bottom support base 37*c*' includes a locking bolt securing hole or opening 37*d*' therein. Moreover, the front toilet bowl support base 36', the rear toilet tank support base 38', and the bottom support base 37*c*' includes a floor support base surface 39'. The toilet bowl 35' includes an outlet passageway (not shown) extending to the floor support surface 39'.

An annular wax ring 40 includes a central communication opening 41 that fluidly communicates with the floor support surface 39' outlet passageway (not shown) when the floor support surface 39' engages a top portion of the annular wax ring 40 that seal the toilet bowl outlet passageway (not shown) as the floor support surface 39' compresses the annular wax ring when a pair of locking bolts 51 are secured within the locking bolt securing hole or opening 37*d*'. This securing action will be discussed later in greater details below.

As shown in FIG. 5, a new and improved clog saver device 10 includes an annular and universal clog saver plate member 11 includes a top surface 12 that supports a bottom surface of the wax ring 40, a bottom surface 19, and a central opening 16 defining an the annular inner wall surface face 17. The annular inner wall surface face 17 of the clog saver plate member 11 includes a plurality of spaced apart and radially inward extending clog saver fins 18 that are directly and integrally attached thereto. Note that the plurality of spaced apart and radially inward extending clog saver fins 18 are the most critical part of the annular and universal clog saver plate member 11. These plurality of spaced apart and radially inward extending clog saver fins 18 are designed to prevent a costly main sewer line clog by isolating the clog between the plurality of spaced apart and radially inward extending clog saver fins 18 and the toilet system 30'.

Also in FIG. 5, the bottom surface 19 engages and is supported on a floor mounting flange plate 42, which will be discussed in greater details below. The plurality of spaced apart and radially inward extending clog saver fins 18 and the top of the surface 12 of the annular and universal clog saver plate member 11 are designed to catch items such as, large feminine hygiene items, disposable pampers, cloth diapers, packaging, clothing, and other large items to prevent a sewer line or passageway blockage, while only allowing small feminine hygiene items, fluid, tissue, toilet liners, dissolvable items, waste material, and small items to flow through the central opening 41 in the wax ring 40 and through the central opening 16 in the annular and universal clog saver plate member 11 and into a sewer line or passageway 68 (See FIG. 6) or 89*c* (See FIG. 7).

As previously mentioned, the annular and universal clog saver plate member 11 having the first pair of separate and oppositely located securing holes or openings defined as the elongated adjustable slots 15 having the first diameter portion 15*a* that decreases to the second diameter portion 15*b* extending through the annular and universal clog saver plate member 11. The aforementioned second pair of separate and oppositely located securing holes or openings defined as the U-shaped slots 14 opens outwardly at the peripheral edge of the annular and universal clog saver plate member 11.

FIG. 5 further shows the floor mount flange plate 42 having a pair of separate and oppositely spaced apart elongated adjustable slots 46 in a top surface 44 having a first diameter portion 46*a* that decreases to a second diameter portion 46*b*, a plurality of securing openings or holes 45, an extended surface portion 47 disposed below the top surface 44 having a plurality of sealing rings or members 48 disposed thereon. The bottom surface 19 of the annular and universal clog saver plate member 11 engages and is supported on the top surface 44 of the annular and universal clog saver plate member 11.

Figure 7:
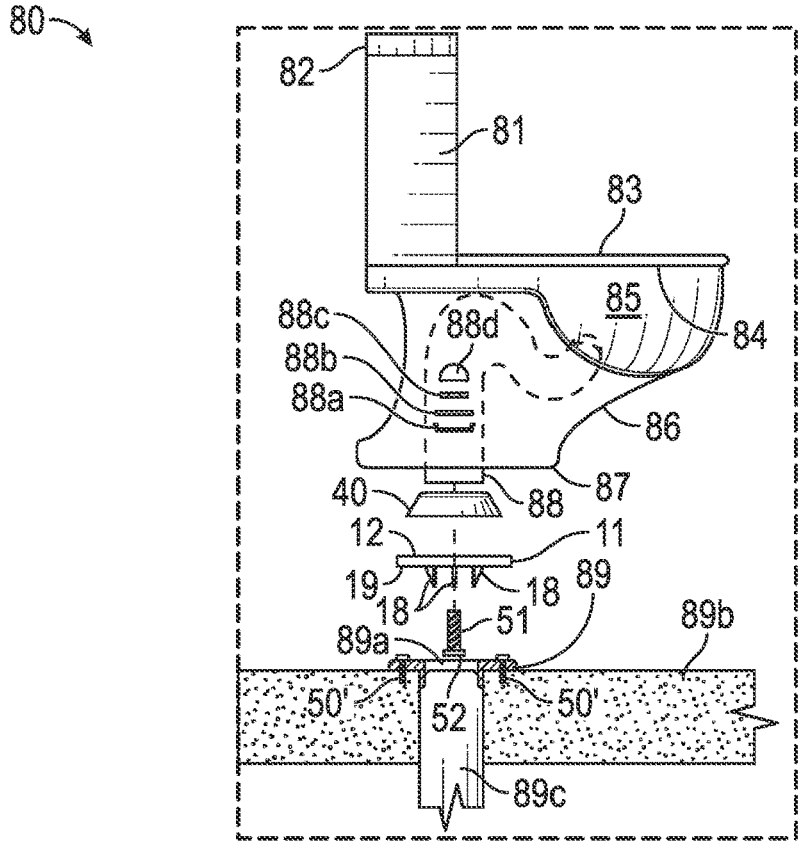
FIG. 7 illustrates an exploded side view of a toilet assembly including a toilet bowl with a wax ring, an annular and universal clog saver plate member with a plurality of angled and radially inward extending spaced apart clog saver fins disposed between a conventional floor mounting flange plate secured to a floor infrastructure by a plurality of securing screw members, and a plurality of flange bolts or studs extending from the floor mounting flange plate to the toilet bowl for securing the wax ring, and the annular and universal clog saver plate member therebetween by a lock washer, retaining washer, threaded nut and cap member.
Figure 8:
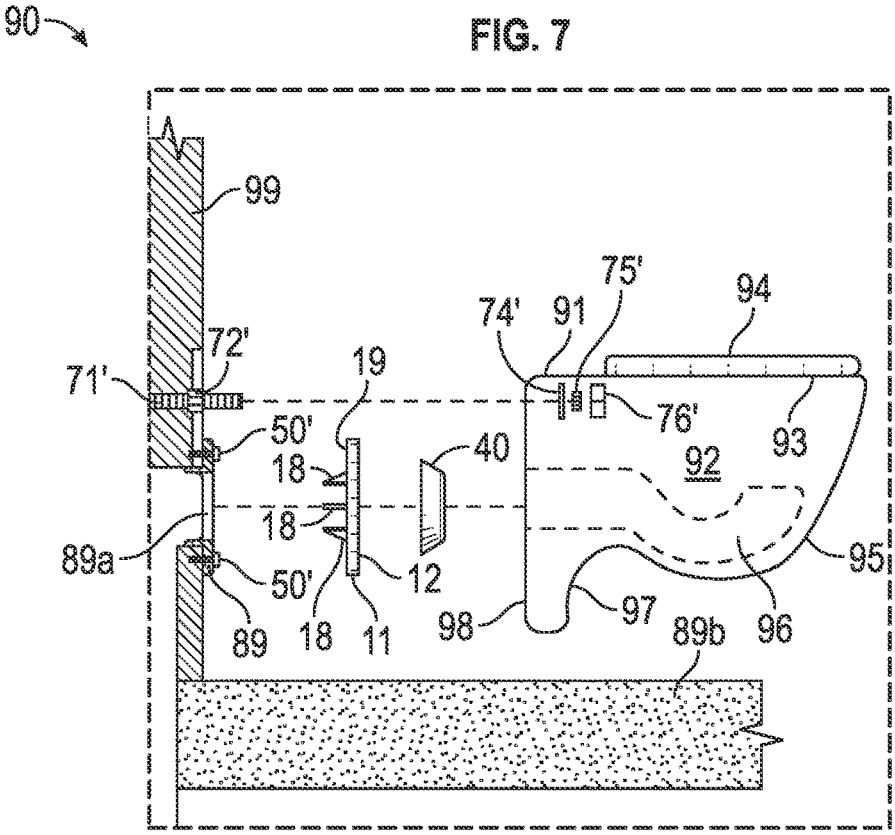
FIG. 8 illustrates an exploded side view of a toilet assembly including a toilet bowl with a wax ring, an annular and universal clog saver plate member with a plurality of angled and radially inward extending spaced apart clog saver fins disposed between a conventional wall mounting flange plate secured to a wall structure by a plurality of screw members, and a plurality of conventional wall bolts or studs with a plurality of securing nuts extending from the wall structure to the toilet bowl for securing the wax ring, the annular and universal clog saver plate member, and the wall mounting flange plate therebetween by a retaining washer, threaded nut and cap member.

In addition, FIG. 5 includes a plurality of threaded anchor bolts to be secured within a floor structure or surface 89*b* (See FIGS. 7 and 8). Next, a plurality of threaded screw members 50 are received through the plurality of securing openings or holes 45 and screwed into the plurality of threaded anchor bolts for securing the floor mount flange plate 42 to the floor structure or surface 89*b* (see FIGS. 7 and 8) with the extended surface portion 47 and the plurality of sealing rings or members 48 disposed thereon are sealingly disposed within a sewer line or passageway 89*c* (See FIG. 7). Furthermore, a pair of locking threaded bolt members 51 including a head portion disposed thereon defining a locking flange member 52. The pair of locking threaded bolt members 51 passes up through the first diameter portion 46*a* of the pair of separate and oppositely spaced apart elongated adjustable slots 46 of the floor mounting flange plate 42 through the first diameter portion 15*a* of the annular and universal clog saver plate member 11 and through an optional lock washer 53. Once the pair of locking threaded bolt members 51 extend through the first diameter portion 15*a* of the annular and universal clog saver plate member 11, the pair of locking threaded bolt members 51 are able to slide into and along each of the elongated adjustable slots 46 into the second diameter portions 46*b* of the floor mounting flange 42, while simultaneously sliding into and along each of the elongated adjustable slots 15 into the second diameter portions 15*b* of the annular and universal clog saver plate member 11 as the locking flange members 52 move along and underneath the second diameter portion 46*b* of the elongated adjustable slots 46 of the floor mounting flange 42. The optional lock washer 53 locks each one of the locking threaded bolt members 51 in place after the locking flange members 52 are positioned underneath each of the elongated and adjustable slots 46 second diameter portions 46*b* of the floor mounting flange plate 42. Note that the lock washer 53 can be omitted, if desired.

The pair of locking threaded bolt members 51 having an extended portion that extends through the pair of elongated adjustable slots 15 of the annular and universal clog saver plate member 11 and through the pair of securing openings or holes 37*d*' in the bottom base portion 37*c*' to a selected distance there above. After the pair of locking threaded bolt members 51 have been slidably moved along the elongated and adjustable slots 46 to the second diameter portions 46*b* of the floor mounting flange plate 42 and slidably moved along the elongated and adjustable slots 15 to the second diameter portions 15*b* of the annular and universal clog saver plate member 11, wherein the extended portion of the pair of locking threaded bolt members 51 aligns and is received through the pair of securing holes 37*d*' in the bottom base portion 37*c*' of the toilet bowl 35' and is extended a distance there above for receiving a retaining washer 54 and a threaded nut 55 for threading the threaded nut 55 along the pair of locking threaded bolt members 51 extended portions until each one of the threaded nuts 55 firmly seats against each one of the retaining washers 54 for tightly securing the toilet bowl 35' to the floor mounting flange plate 42. Once each one of the threaded nuts 55 has been fully tightened, the wax ring 40 is sealingly compressed between the bottom base portion 39' of the toilet bowl 35' and the top surface 12 of the annular and universal clog saver plate member 11 to fully seal the drain outlet passageway of the toilet bowl 35' that is fluidly connected to the floor drain opening 89*a* or sewer line or passageway 89*c* (see FIG. 7), wherein this sealing action seals flow communication via the central opening 41 in the wax ring 40, the central opening 16 of the annular and universal clog saver plate member 11, and the central opening 43 of the floor mounting flange plate 42. After each one of the threaded nuts 55 has been fully tightened, a decorative cap member 56 is placed over each one of the threaded nuts 55 for esthetic purposes.

Figure 6:
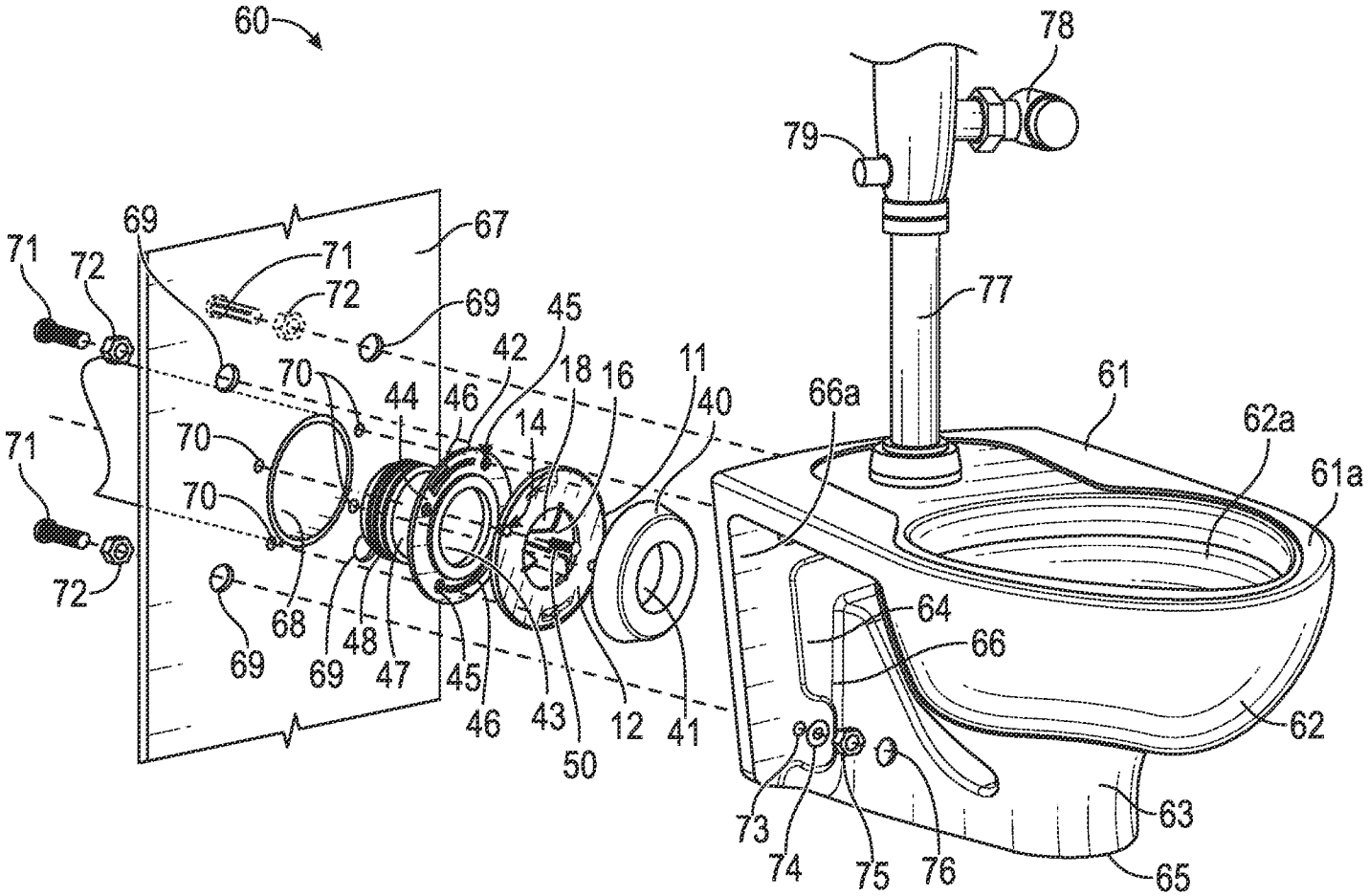
FIG. 6 illustrates an exploded isometric view of a toilet assembly including a toilet bowl with a wax ring, an annular and universal clog saver plate member with a plurality of angled and radially inward extending spaced apart clog saver fins secured within a central opening thereof disposed between a wall mounting flange secured to a wall structure by a plurality of screw members, and a plurality of wall bolts or studs with a plurality of securing nuts extending from the wall structure to the toilet bowl for securing the wax ring, the annular and universal clog saver plate member, and the wall mounting flange plate therebetween by a retaining washer, threaded nut and cap member.

Now referring to FIG. 6, this embodiment teaches a wall mount toilet bowl assembly 60 that can easily provide the annular and universal clog saver plate member 11 thereto. Note that the toilet bowl assembly 60 includes a toilet bowl 62 with a top rear surface 61, a top front seat surface, an interior toilet bowl fluid chamber 62*a*, an integral toilet bowl support base 63 that includes a recess cavity 64 defined by front wall portion 66, a rear wall portion 66*a*, a support base bottom floor surface 65, a pair of wall mount securing openings or holes 73 disposed on opposite sides of rear wall portion 66*a*, a toilet bowl water supply line 77 connected at the top rear surface 61, a wall water supply connection pipe 78, and a flush handle 79.

FIG. 6 further includes a wax ring 40 with a central opening 41, an annular and universal clog saver plate member 11 with a central opening 16 having a wall portion that includes a plurality of spaced apart and radially inward extending clog saver fins 18 that are directly and integrally attached thereto, and a sewer line or passageway 68 in a wall structure or surface 67 for sealingly receiving a wall or floor mount flange plate 42 therein. Note that the wall or floor mount flange plate 42 is universal in either mounting. The wall mount flange plate 42 includes a plurality of threaded screw members 50 are received through the plurality of securing openings or holes 45 of the wall or floor mount flange plate 42 and screwed into the plurality of threaded opening or holes 70 in the wall structure 67 for securing the wall mount flange 42 to the wall structure or surface 67. Moreover, the mounting flange plate 42 as discussed above for FIG. 5 having the pair of separate and oppositely mounted securing holes or openings thereon defining the pair of elongated adjustable slots 46 having the first diameter portion 46*a* that decreases to the second diameter portion 46*b* is not necessary for mounting the wall mount toilet bowl assembly 60 to the wall structure or surface 67.

The pair of separate and oppositely mounted securing holes or openings 15 disposed through the annular and universal clog saver plate member 11 defining the pair of elongated adjustable slots 15 having the first diameter portion 15*a* that decreases to the second diameter portion 15*b* disposed in the annular and universal clog saver plate member 11 that aligns and mates with the elongated adjustable slots 46 in the floor mounting flange plate 42 having the first diameter portion 46*a* that decreases to the second diameter portion 46*b* is not necessary for mounting the wall mount toilet bowl assembly 60 to the wall structure or surface 67. However, the pair of separate and oppositely mounting securing holes or openings defining the U-shaped slots 14 of the annular and universal clog saver plate member 11 that opens outwardly at the peripheral edge of the annular and universal clog saver plate member 11, which aligns and mate with at least a pair of the securing holes or openings 45 in the wall mounting flange plate 42 for securing the annular and universal clog saver plate member 11 directly to the wall mounting flange plate 42 by at least a pair of the threaded screw members 50 that extend therethrough and further extending through the plurality of securing openings or holes 70 of the wall structure or surface 67. This securing action threadingly secures the annular and universal clog saver plate member 11 and the wall mounting flange plate 42 to the wall structure or surface 67.

In addition, the wall structure or surface 67 includes a plurality of spaced apart threaded locking stud bolt openings or holes 69 disposed therein for receiving a plurality of threaded locking stud bolts 71 therethrough and a threaded locking nut 72 for securing the plurality of threaded locking stud bolts 71 at the wall structure or surface with a portion of the plurality of threaded locking stud bolts 71 extending a selected distance therefrom. The extended portion of the plurality of threaded locking stud bolts 71 is received through a plurality of toilet bowl securing openings or holes 73 in the rear wall portion 66*a* of the recess cavity 64 for receiving a retaining washer 74 and a threaded nut 75 on each one of the plurality of threaded locking stud bolts 71 for securing and locking the wall mount toilet bowl assembly 60 to the wall structure or surface 67. A decorative cap 76 is used for covering each one of the threaded nuts 75 for esthetic purpose.

Note that when the annular and universal clog saver plate member is used with the wall-mounted toilet bowl, it is imperative that the pair of U-shaped slots 14 of the annular and universal clog saver plate member 11 mounting points must be installed on a level plane, and oriented so that they are located at 3 o'clock and 9 'clock positions relative to and aligned with the pair of plurality of securing holes 45 in the wall mounting flange plate 42. This orientation places the highest most spaced apart radially inward extending clog saver fin 18 at the 12 o'clock position and the two remaining spaced apart radially inward extending clog saver fins 18 are located at 8 o'clock and 4 o'clock positions defining the correct and non-clogging installation position. However, if the annular and universal clog saver plate member 11 is oriented 180 degrees and the lowest spaced apart radially inward extending clog saver fin 18 is positioned at the 6 o'clock position there will be recurring clogging due to all solids passing over the lowest positioned spaced apart radially inward extending clog saver fin 18, which would be considered the incorrect installation position.

Now referring to FIG. 7, this embodiment represents an existing floor mount toilet bowl assembly 80 that can easily add the new and improved annular and universal clog saver plate member 11 thereto to prevent a main sewer line or passageway clog or blockage by isolating the clog or blockage to the toilet bowl assembly 80 above the main sewer line or passageway 89*c*.

The existing floor mount toilet bowl assembly 80 includes a toilet water tank 81, toilet tank cover 82, toilet seat cover 83, toilet seat 84, toilet bowl 85, toilet bowl support base 86, a toilet bowl support base floor surface 87, toilet bowl fluid discharge passageway 88, floor mounting flange plate 89 mounted to a floor infrastructure 89*b* by screw threaded members 50', floor mounting flange central opening 89*a* that is in fluid communication with a sewer line or passageway 89*c*, an annular and universal clog saver plate member 11 having a top surface 12, bottom surface 19, central opening 16 (See FIG. 1), a plurality of spaced apart radially inward extending clog saver fins 18, and a wax ring 40 with a central opening 41. Moreover, a pair of threaded locking bolts 52 with a locking flange 52 (only one is shown) is utilized to lock and maintain the floor mounting flange 89, the annular and universal clog saver plate member 11, the wax ring 40 to the toilet bowl 85 with locking washer 88*a*, retaining washer 88*b*, and threaded locking nut 88*c*. Decorative cap 88*d* is placed over the threaded locking nut 88*c* for esthetic purpose. See details of the locking arrangement and fluid flow communication of the above elements and how they operate together in a similar fashion as described above in FIG. 5. This was not covered here in order to avoid redundancy.

Note that FIG. 8 represents an existing wall mount toilet bowl assembly 80 that can easily add the new and improved annular and universal clog saver plate member 11 thereto to prevent a main sewer line or passageway clog or blockage by isolating the clog or blockage to the toilet bowl assembly 90 above a main sewer line or passageway (not shown) but is fluidly connected to the central opening 89*a* of the wall mounting flange plate 89.

The existing wall mount toilet bowl assembly 91 includes a toilet seat cover 94, toilet seat 93, toilet bowl 92, toilet bowl outer surface portions 95, 97, a toilet bowl rear wall support surface 98, toilet bowl fluid discharge passageway 96, wall mounting flange 89 mounted to a wall structure 99 by screw threaded members 50', wall mounting flange central opening 89*a* that is in fluid communication with a sewer line or passageway (not shown) but is fluidly connected to the central opening 89*a* of the wall mounting flange 89, an annular and universal clog saver plate member 11 having a top surface 12, bottom surface 19, central opening 16 (See FIG. 1), the plurality of spaced apart radially inward extending clog saver fins 18, and a wax ring 40 with a central opening 41. Moreover, a plurality of existing threaded locking bolts 71' (only one is shown) with a plurality of locking nuts 72 is utilized to lock and maintain the wall mounting flange 89, the annular and universal clog saver plate member 11, the wax ring 40 to the rear wall 98 of the toilet bowl 91 with retaining washer 74', and threaded locking nut 75'. Decorative cap 76' is placed over the threaded locking nut 75' for esthetic purposes. See details of the locking arrangement and fluid flow communication of the above elements and how they operate together are the same as described above in FIG. 6. This was not covered here in order to avoid redundancy.

It is to be noted that the annular and universal clog saver plate members 11, 21, and 31 and the floor or wall mounting flange plates 42 or 89 are universal and can be utilized to mount toilet bowl assemblies 30', 60, 80, and 90 either to a floor or wall structure. As previously mentioned above the U-shaped slots 14 of the annular and universal clog saver plate members 11, 21, and 31 must be oriented in a certain secured position relative to and aligned with the pair of plurality of securing holes 45 in the wall mounting flange plate 42 to provide a correct and non-clogging installation. However, if the U-shaped slots 14 of the annular and universal clog saver plate members 11, 21, and 31 are oriented in any other secured positions relative to and aligned with the pair of plurality of securing holes 45 in the wall mounting flange 42 results in an incorrect and a recurring clogging installation position.

While the foregoing written description of the invention enables one of ordinary skill in the art to make and use what is considered presently to be the best mode thereof, those of ordinary skill will understand and appreciate the existence of variations, combinations, and equivalents of the specific embodiment, method, and examples herein. The invention should therefore not be limited by the above described embodiments, and examples, but by all embodiments and methods within the scope and spirit of the invention as claimed.

What is claimed is:

1. A toilet assembly having a clog saving device comprising:

a toilet bowl including an internal water chamber, a water discharge passageway fluidly connected to the internal water chamber, and a support base that engages and is secured to a building infrastructure surface;

a wax ring having a central opening disposed therein and is in fluid communication with the toilet bowl water discharge passageway, and top and bottom engaging surfaces;

the clog saving device includes a clog saver plate member, the clog saver plate member having top and bottom engaging surfaces, a central opening defining an annular inner wall surface face that is fluidly connected to the central opening in the wax ring and the toilet bowl water discharge passageway, a plurality of clog saver fins are secured directly and integrally to the annular inner wall surface face of the central opening of the clog saver plate member, the plurality of clog saver fins are located below and separate from the wax ring, a first plurality of oppositely spaced apart elongated securing slots having a first diameter portion at one end thereof, and decreasing into a second diameter portion at the other end thereof, and a second plurality of oppositely spaced apart securing slots defining a U-shape with an open end disposed at an outer peripheral edge of the clog saver plate member; and a mounting flange plate including a top surface and a bottom surface with an extending portion that is sealingly disposed within a sewer drain passageway, a central opening that is in fluid communication with the sewer drain passageway, the plurality of clog saver fins extends radially inward and downward into the central opening of the mounting flange plate at a selective distance therein, and positioned at a selective orientation therein, a first plurality of oppositely spaced apart elongated securing slots having a first diameter portion at one end thereof, and decreasing into a second diameter portion at the other end thereof, and a second plurality of securing holes disposed therein, and a plurality of screws securing the mounting flange plate to the building infrastructure surface via the second plurality of securing holes and threaded into a plurality of anchor stud bolts fixedly secured in the building infrastructure surface.

2. The toilet assembly having the clog saving device according to claim 1, wherein the clog saver plate member and the plurality of clog saver fins can be made of varied materials selected at least from the group consisting of plastics and metals.

3. The toilet assembly having the clog saving device according to claim 2, wherein the plurality of clog saver fins can be of varied selected sizes and shapes, and positioned and spaced at varied selected angles within the central opening of the clog saver plate member of varied selected sizes thereof to allow only fluid, tissue, toilet liners, waste material, passable items, including at least one of, feminine hygiene items, and dissolvable items to pass there through, while preventing any sewer line or passageway blockage by isolating non-passable feminine hygiene items, packaging items, clothing items, disposable pampers, and cloth diapers that will be caught and collected by and isolated between the plurality of clog saver fins, and the toilet bowl for allowing removal of the at least one of the non-passable items without having to remove the toilet bowl.

4. The toilet assembly having the clog saving device according to claim 1, wherein the plurality of clog saver fins can extend at varied selected distances near and below the bottom engaging surface of the clog saver plate member at a selected angle relative to the central opening of the clog saver plate member.

5. The toilet assembly having the clog saving device according to claim 1, wherein the annular inner wall surface face of the clog saver plate member includes a plurality of securing slots disposed therein, and the plurality of clog saver fins includes a securing tab disposed at a top edge thereof, wherein each one of the securing tabs of the plurality of clog saver fins are directly and integrally attached within the plurality of securing slots.

6. The toilet assembly having the clog saving device according to claim 5, wherein the clog saver fins are secured directly and integrally to the annular inner wall surface face, and the plurality of securing tabs are directly and integrally attached within the plurality of securing slots by a bonding process selected at least from the group consisting of chemical bonding, welding, soldering, cementing, and gluing.

7. The toilet assembly having the clog saving device according to claim 1, wherein the building infrastructure surface is selected from the group consisting of a floor surface and a wall surface.

8. The toilet assembly having the clog saving device according to claim 7, wherein the plurality of anchor stud bolts is secured within the floor surface, the mounting flange plate extending portion having a plurality of sealing members disposed thereon and are sealingly disposed within the sewer drain passageway, a pair of locking threaded bolt members including a head portion disposed thereon defining a locking flange member, the pair of locking threaded bolt members passes up through the first diameter portion of the first plurality of oppositely spaced apart elongated securing slots of the mounting flange plate, through the first diameter portion of the first plurality of oppositely spaced apart elongated securing slots of the clog saver plate member, and through a lock washer, wherein an extended portion of the pair of locking threaded bolt members passes through a pair of securing holes disposed in the support base of the toilet bowl to receive a retaining washer and a threaded nut for threadingly securing the support base of the toilet bowl to the floor surface by threading the threaded nut along each one of the pair of locking threaded bolt members extended portions until each one of the threaded nuts firmly seats against each one of the retaining washers for tightly securing the toilet bowl relative to the mounting flange plate and the floor surface.

9. The toilet assembly having the clog saving device according to claim 8, wherein the pair of locking threaded bolt members are able to slide into and along each pair of the plurality of oppositely spaced apart elongated securing slots second diameter portions of the mounting flange plate and the clog saver plate member as the locking flange members move along and underneath the second diameter portions of the plurality of oppositely spaced apart elongated securing slots of the mounting flange plate, and the lock washer locks each one of the locking threaded bolt members in place after the locking flange members are positioned underneath each one of the plurality of oppositely spaced apart elongated securing slots second diameter portions of the mounting flange plate.

10. The toilet assembly having the clog saving device according to claim 9, wherein the fully tightening of each one of the threaded nuts causes the wax ring to be sealingly compressed between the support base of the toilet bowl and the top engaging surface of the clog saver plate member to fully seal the water discharge passageway of the toilet bowl that is fluidly connected to the sewer drain passageway via the central opening in the wax ring, the central opening of the clog saver plate member, and the central opening of the mounting flange plate, whereby a decorative cap member is placed over each one of the threaded nuts for esthetic purposes.

11. A clog saving apparatus attached to a toilet system comprising:

an annular and universal clog saver plate member;

the annular and universal clog saver plate member includes a top surface and a bottom surface, a central opening defining an annular inner wall surface face, a plurality of spaced apart clog saver fins are attached directly and integrally to the annular inner wall surface face and extending radially inward into the central opening of the annular and universal clog saver plate member at a selected angle therein, and being separate from and in non-contact with the wax ring, at least a first pair of oppositely spaced apart elongated adjustable slots having a first diameter portion at one end thereof, and decreasing into a second diameter portion at the other end thereof, and at least a second pair of oppositely spaced apart securing slots defining a U-shape with an end disposed at an outer peripheral edge of the annular and universal clog saver plate member;

the toilet system includes a toilet bowl including an internal water chamber, a water discharge passageway connected to the internal water chamber, a support base including a plurality of mounting holes disposed therein, and the support base engages and is fixedly attached to a building infrastructure surface;

a wax ring having a central opening disposed therein, and a top surface and a bottom surface disposed thereon; and a universal mounting flange plate including a top surface and a bottom surface with a portion sealingly disposed within a sewer drain passageway, a central opening disposed therein, at least a pair of oppositely spaced apart elongated adjustable slots having a first diameter portion at one end thereof, and decreasing into a second diameter portion at the other end thereof, and a first plurality of securing holes disposed therein, and a plurality of screw members securing the universal mounting flange plate to the building infrastructure via the first plurality of securing holes in the mounting flange plate and through a second plurality of securing holes in the building infrastructure surface; and the annular and universal clog saver plate member with the plurality of spaced apart clog saver fins that extends radially inward and downward into the central opening of the universal mounting plate at a selective distance therein are disposed between the wax ring and the universal mounting flange plate upon the toilet bowl being secured to the building infrastructure surface, and compressing the wax ring and sealing the support base of the toilet bowl against the building infrastructure surface by a plurality of threaded stud bolt members and a plurality of threaded retaining nuts threadingly received on the plurality of threaded stud bolts, wherein the annular and universal clog saver plate member with the plurality of spaced apart clog saver fins extends a selective distance radially inward into the central opening of the universal mounting flange plate at a selective orientation that will trap large items from passing to the sewer drain passageway and isolate them between the annular and universal clog saver plate member, the plurality of spaced apart clog saver fins, and the toilet bowl.

12. The clog saving apparatus attached to the toilet system according to claim 11, wherein the building infrastructure surface is selected from the group consisting of a wall surface and a floor surface.

13. The clog saving apparatus attached to the toilet system according to claim 11, wherein the annular and universal clog saver plate member and the plurality of spaced apart clog saver fins can be made of varied materials selected at least from the group consisting of plastics and metals.

14. The clog saving apparatus attached to the toilet system according to claim 13, wherein the plurality of spaced apart clog saver fins can be of varied selected sizes and shapes, and the selected angle can be positioned and spaced at varied selected angles within the central opening of the annular and universal clog saver plate member having varied selected sizes thereof to allow fluid, tissue, toilet liners, waste material, passable items, including at least one of, feminine hygiene items, and dissolvable items to pass through the annular and universal clog saver plate member and into the sewer drain passageway, while preventing any blockage of the sewer drain passageway by isolating non-passable items, including at least one of, feminine hygiene items, packaging items, clothing items, disposable pampers, and cloth diapers that will be trapped and collected by and isolated between the plurality of spaced apart clog saver fins, and the toilet bowl for allowing removal of the at least one of the non-passable items without having to remove the toilet bowl.

15. The clog saving apparatus attached to the toilet system according to claim 13, wherein the plurality of spaced apart clog saver fins can extend at varied selected distances near and below the bottom surface of the annular and universal clog saver plate member at a selected angle relative to the central opening of the annular and universal clog saver plate member.

16. The clog saving apparatus attached to the toilet system according to claim 13, wherein the annular inner wall surface face of the annular and universal clog saver plate member includes a plurality of securing slots disposed therein, and the plurality of spaced apart clog saver fins includes a securing tab disposed at a top edge thereof, wherein each one of the securing tabs of the plurality of securing slots are inserted and securely attached directly and integrally within the plurality of securing slots.

17. The clog saving apparatus attached to the toilet system according to claim 16, wherein the spaced apart clog saver fins are secured directly and integrally to the annular inner wall surface face, and the plurality of securing tabs are inserted and securely attached directly and integrally within the plurality of securing slots in the annular inner wall surface face by a bonding process selected at least from the group consisting of chemical bonding, welding, soldering, cementing, and gluing.

18. The clog saving apparatus attached to the toilet system according to claim 12, wherein at least a pair of the screw members are inserted through the U-shaped slots of the annular and universal clog saver plate member for fixedly securing the bottom surface of the annular and universal clog saver plate member directly to and against the top surface of the universal mounting flange plate in a selected orientation so that the plurality of spaced apart clog saver fins are arranged in a selected non-clogging position only when mounted to the wall surface of the building infrastructure surface, and is not required when mounted to the floor surface.

19. The clog saving apparatus attached to the toilet system according to claim 12, wherein a plurality of stud bolt securing holes are disposed in the wall surface for anchoring the plurality of threaded stud bolts therein by threading a plurality of receiving threaded nuts thereon with a threaded portion extending therefrom, each one of the extended threaded portions is received through a plurality of mounting holes in a rear wall surface of the support base of the toilet bowl, wherein each one of the extended threaded portions receives a retaining washer thereon and the plurality of threaded retaining nuts for threading each one of the plurality of threaded retaining nuts along each one of the extended threaded portions until each one of the plurality of threaded retaining nuts tightly engages against each one of the retaining washers, and the rear wall surface of the support base of the toilet bowl engages against the wall surface so that the toilet bowl is fixedly secured against the wall surface, and then a decorative cap is placed over each one of the threaded retaining nuts for esthetic purpose.

20. A toilet assembly having a clog saving apparatus for isolating and trapping a blockage between the toilet assembly, and the clog saving apparatus, the toilet assembly comprising:

a toilet bowl member including a water chamber with a communicating water discharge passage, and a toilet bowl support base having a mounting portion with a plurality of mounting holes disposed therein;

a wax ring having a top surface, a bottom surface, a central opening communicating with the water discharge passage and positioned adjacent the toilet bowl support base;

the clog saving apparatus includes an annular clog saver plate member with a top surface, a bottom surface, a central opening having an inner wall surface, a plurality of clog saver fins being selected from varied sizes and shapes and attached directly and integrally to the inner wall surface at varied selective angles that extend radially inward of the central opening of the annular clog saver plate member, and the plurality of clog saver fins are positioned below and separate from the wax ring, the annular clog saver plate member, and the plurality of clog saver fins can be made from varied materials selected at least from the group consisting of plastics and metals;

a building infrastructure having a sewer drain passageway disposed therein;

a mounting flange plate having a top surface, a bottom surface with an extended portion with sealing members disposed thereabout and being positioned within the sewer drain passageway with the bottom surface resting on and secured to the building infrastructure, and the top surface of the mounting flange plate supporting and receiving the bottom surface of the annular clog saver plate member and secured thereto with the plurality of clog saver fins extending radially inward of the central opening of the annular clog saver plate, and being positioned at a selective distance downward into the central opening of the mounting flange plate;

the wax ring is supported on the top surface of the annular clog saver plate member and is always in non-contact with the plurality of clog saver fins;

at least a pair of bolt and nut members extending from the building infrastructure, operably associated with the mounting flange plate and the annular clog saver plate member and received through the plurality of mounting holes of the toilet bowl support base mounting portion and secured thereto and sealingly compressing the wax ring between the support base mounting portion and the annular clog saver plate member, and aligning the central openings of the wax ring, the annular clog saver plate member, and the mounting flange plate with the communicating water discharge passageway of the water chamber, and the sewer drain passageway allow water communication to pass there through; and wherein the annular clog saver plate member and the plurality of clog saver fins are designed to be oriented in a selective position relative to the mounting flange plate when secured together to allow fluid, tissue, toilet liners, waste material, passable items, including at least one of, feminine hygiene items, dissolvable items to pass through the annular clog saver plate member and into the sewer drain passageway, while preventing any blockage of the sewer drain passageway by isolating non-passable items, including at least one of, feminine hygiene items, packaging items, clothing items, disposable pampers, and cloth diapers that will be trapped and collected by and isolated between the plurality of clog saver fins, and the toilet bowl for allowing removal of the at least one of the non-passable items without having to remove the toilet bowl.

* * * * *